US006397720B1

(12) United States Patent
Fox et al.

(10) Patent No.: US 6,397,720 B1
(45) Date of Patent: Jun. 4, 2002

(54) CARTRIDGE CASE REFORMING DIE HAVING PRECISE MEASURING SYSTEM

(75) Inventors: Thomas Michael Fox, 9433 S. 157th Pl., Gilbert, AZ (US) 85234; Jay Robert Mitchell, Mesa, AZ (US)

(73) Assignee: Thomas Michael Fox, Gilbert, AZ (US)

( * ) Notice: Subject to any disclaimer, the term of this patent is extended or adjusted under 35 U.S.C. 154(b) by 0 days.

(21) Appl. No.: 09/633,976

(22) Filed: Aug. 8, 2000

(51) Int. Cl.[7] ..... F42B 33/10

(52) U.S. Cl. ..... 86/24; 86/24; 86/29; 86/31; 86/23

(58) Field of Search ..... 86/24, 29, 31, 86/43, 23

(56) References Cited

U.S. PATENT DOCUMENTS

| | | | | | |
|---|---|---|---|---|---|
| D199,862 | S | | 12/1964 | Lowry | |
| 3,266,075 | A | | 8/1966 | Conrad | |
| 3,408,892 | A | * | 11/1968 | Smith et al. | 86/23 |
| 3,705,515 | A | | 12/1972 | Lee | 72/367 |
| 3,745,875 | A | * | 7/1973 | Kennedy | 86/23 |
| 4,174,575 | A | | 11/1979 | Nakata | 33/164 |
| 4,189,980 | A | | 2/1980 | Schaenzer | 86/24 |
| 4,248,132 | A | * | 2/1981 | Blomseth | 86/24 |
| 4,510,842 | A | | 4/1985 | Hlusko | 86/25 |
| 4,653,191 | A | * | 3/1987 | Gasser | |
| 4,723,472 | A | * | 2/1988 | Lee | 86/23 |
| 4,836,078 | A | * | 6/1989 | Lee | 86/24 |
| 4,862,567 | A | | 9/1989 | Beebe | 29/1.23 |
| 4,869,148 | A | * | 9/1989 | Tucker | 86/23 |
| 4,918,825 | A | | 4/1990 | Lesh et al. | 33/506 |
| 5,221,806 | A | | 6/1993 | Chaney et al. | 86/19 |
| 5,635,661 | A | | 6/1997 | Tuftee | 86/24 |
| 5,649,465 | A | * | 7/1997 | Beebe | 86/24 |
| 6,131,302 | A | * | 10/2000 | Hohmann et al. | |
| 6,244,154 | B1 | * | 6/2001 | Beebe et al. | 86/43 |

* cited by examiner

*Primary Examiner*—Michael J. Carone
*Assistant Examiner*—Lulit Semunegus
(74) *Attorney, Agent, or Firm*—Bradley J. Botsch, Sr.

(57) ABSTRACT

A novel resizing die (100/300) for a cartridge case has been provided for efficiently and quickly resizing a cartridge case during a reloading operation. The novel die includes a precise measuring system (122, 124, 108/122, 306, 108) for being able to accurately and precisely adjust the position of the resizing die when already threaded into an internal bore of a reloading press so that after a first resizing process is performed, the resizing die of the present invention may be precisely adjusted by the length that the cartridge's head-space distance is too long or too short so that the next resizing process will yield a cartridge headspace distance that is in substantial accordance with a predetermined length.

11 Claims, 3 Drawing Sheets

CARTRIDGE CASE REFORMING DIE HAVING PRECISE MEASURING SYSTEM

FIELD OF INVENTION

This invention relates to an apparatus for reloading firearm cartridges, and more particularly, to a die that provides proper forming of the cartridge case and for quickly and efficiently ensuring proper cartridge case headspace distance when inserted into the die.

BACKGROUND OF THE INVENTION

Cartridge cases are reloaded by individuals for a plurality of reasons. For example, the individual may desire to control the powder charge, the sizing of the bullet, or the resizing of the case. Further, the process for reloading cartridges may be practiced by hobbyists who wish to tailor make their ammunition or save money by reloading their own cartridges.

When a round of ammunition is fired, the cartridge case may be enlarged both by length and in diameter in that the cartridge is expanded longitudinally and also the body and neck of the cartridge case is expanded. In order to reuse a cartridge that has been fired, the cartridge needs to be properly resized. Accordingly, a resizing die is utilized that is typically mounted into a reloading press and the cartridge case is pressed axially into an internal bore of the resizing die to compress and reform the sides of the cartridge case into an appropriate cross sectional configuration. Accordingly, the diameters of the body and neck are shrunk down to their original tolerances.

In a typical cartridge case resizing process, the user is typically required to place the resizing die in a press and then, by trial and error, determine how far the resizing die should be threaded into a bore of the press so that when the cartridge case is resized, the headspace distance of the cartridge does not turn out to be too short, in which the cartridge case needs to be discarded and is of no use, or is too long in which the cartridge case again needs to be resized and remeasured.

Accordingly, it would be desirable to provide an apparatus and method for quickly and efficiently ensuring proper placement of the resizing die as it relates to the reloading press such that after one cartridge is resized, the reloading die can be properly adjusted to be at the proper position in the reloading press thereby ensuring proper headspace distance of the resized cartridge.

DETAILED DESCRIPTION OF THE DRAWINGS

Figure 1:
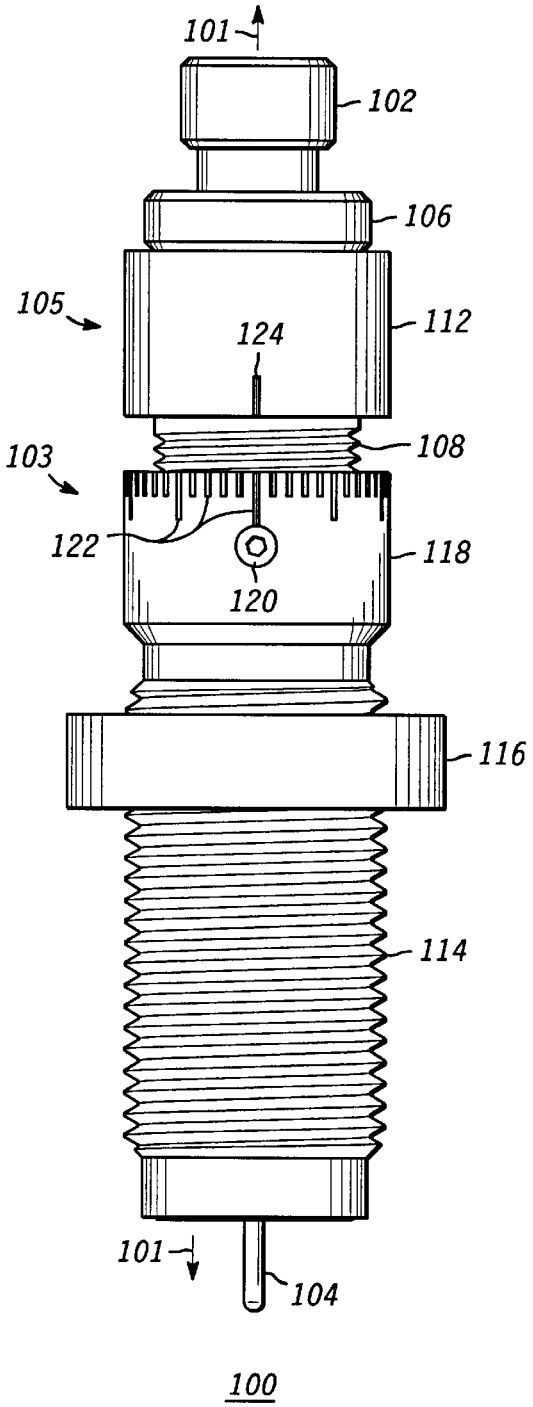
FIG. 1 is a pictorial diagram illustrating a first embodiment of the present invention.

The present invention relates to an apparatus and method for quickly and efficiently resizing a cartridge case in a reloading operation so as to ensure that the headspace distance of the resized cartridge case is the proper length.

Referring to U.S. Pat. No. 5,221,806 of Chaney et al., there is disclosed a multiple purpose die for a reloading press. The subject matter of the '806 patent is incorporated by reference herein. In particular, referring FIG. 1 of the '806 patent, there is shown a single station reloading press 10. which is well known to those skilled in the art. Further, referring to column 2, lines 53 through column 3, line 49 of the '806 patent, a detailed description of the operation of reloading press 10 is described. Again, this particular citation within the '806 patent is again incorporated by reference herein for its teachings with respect to the operation of reloading press 10. As mentioned specifically in the '806 patent, the die block holder 14 is provided with a threaded bore 24 for the adjustable mounting of an externally threaded resizing die 30 whereby the die 30 is threadably inserted into the bore 24 and is adjusted to the proper operating height relative to the stroke of the ram 12 and is then secured in position by a lock nut 26. However, it must be understood that the adjustment of die 30 into bore 24 of the press is a trial and error process whereby a first cartridge is placed on cartridge case holder 18 and operating handle 16 is then moved in a downward direction, thereby moving the cartridge case 28 into the holder 18 on the end of ram 12 towards die 30, and, as the handle movement continues, case 28 will enter die 30 and a resizing/reloading operation will be performed. Once this operation has been done, the headspace distance of the cartridge case may be measured by a precision micrometer device such as one described in U.S. Pat. No. 4,918,825 or the "Precision Mic" manufactured by Blount, Inc. If the headspace distance of this cartridge case is too small according to the manufacturer's tolerances, then the cartridge case must be discarded because a cartridge case that is too short is typically not workable. However, desirably die 30 will not be threaded too far into bore 24 and the resulting headspace distance of the resized cartridge case will be too long. Accordingly, the user will then make minor adjustments/tweaks to the position of die 30 into bore 24 and perform another resizing operation after which the cartridge case is again remeasured. This operation or process is continued until the user has adjusted the depth of reforming die 30 properly into bore 24 so that when measuring the headspace distance of the reformed cartridge case, it is of proper length per manufacture tolerances. However, as can be seen from the above description, this process is a trial and error process and can be quite time consuming.

Accordingly, the present invention provides a resizing die that includes a precise measuring system for being able to accurately and precisely adjust the position of the resizing die when already threaded into an internal bore of a reloading press so that after a first resizing process is performed, the resizing die of the present invention may be precisely adjusted by the length that the cartridge is too long or short so that the next resizing process will yield a cartridge headspace distance that is in substantial accordance with a predetermined length.

Figure 2:
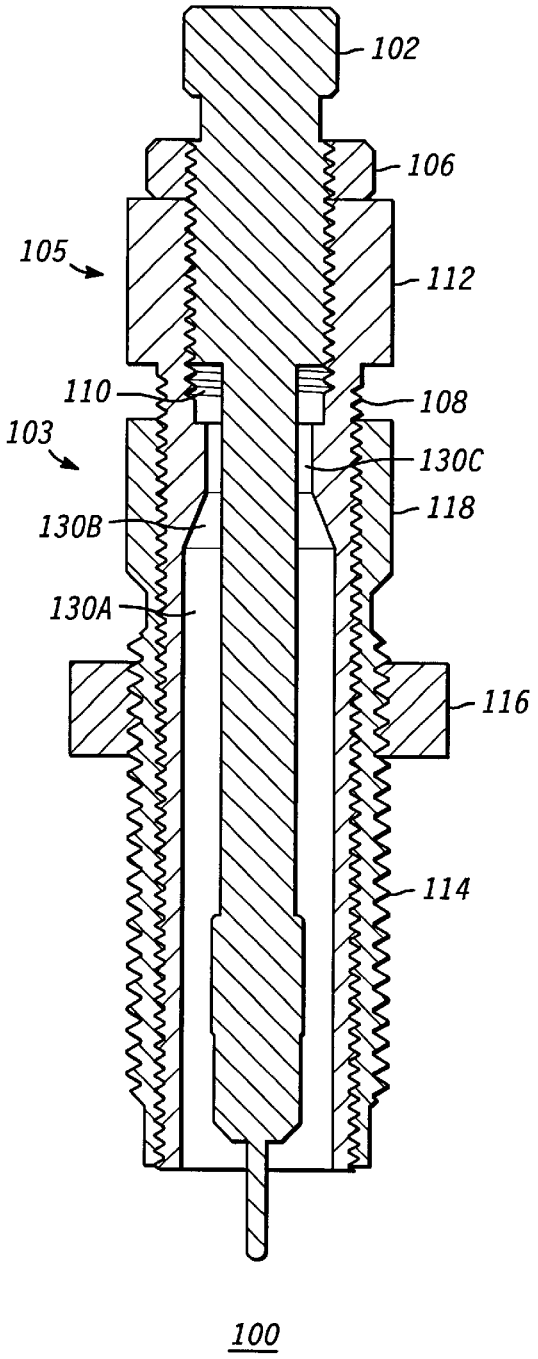
FIG. 2 is a cross-sectional view of the resizing die taken along lines 101—101 in FIG. 1.

Referring now to FIGS. 1 and 2, a first embodiment of the present invention is shown. FIG. 1 is a pictorial diagram illustrating resizing die 100 while FIG. 2 is a cross sectional view of die 100 taken along lines 101—101 of FIG. 1. Resizing die 100 is comprised of three major portions; first portion 103, second portion 105 and third portion 102 whereby each of these three portions are separate components of the present invention and whereby portion 105 is threadably inserted into portion 103 and whereby portion 102 is threadably inserted into portion 105.

First portion 103 includes external threads 114 for being threadably inserted into a bore of a holding press, such as bore 24 of holding press 10 of the '806 patent. Once first portion 103 is initially seated into a bore of a reloading press, jam nut 116 is used to secure first portion 103 into the reloading press similarly as was described with respect to lock nut 26 of the '806 patent. Additionally, first portion 103 includes upper portion/head 118 which includes lock screw 120 and index/registration marks 122 both of which are for use in the precision system of the present invention and will be described in more detail hereinafter.

Second portion 105 of resizing die 100 includes external threads 108 on its lower portion for being threadably inserted into the inside of first portion 103. The inside of second portion 105 includes bore 130 which is configured to receive a cartridge case for resizing whereby bore 130 is typically configured to receive a cartridge case of a predetermined caliber/size. However, it is understood that the scope of the present invention applies to resizing any and all sizes of cartridge cases. Lower portion 130*a* of the bore has a cylindrical inner wall surface with a cross-section configuration substantially conforming to the desired external configuration to which the main body portion of a cartridge case is to be formed. A sloping bore section 130*b* has an internal cross-section configuration substantially conforming to the external configuration to which the shoulder portion of a resized cartridge case is to be formed. Finally, bore section or neck 130*c* has an inner wall surface defining a cross-section internal configuration substantially conforming to the desired external configuration to which the neck of a cartridge case is to be sized. Second portion 105 is adjustably positioned in an axial manner within first portion 103 by simply turning second portion 105 in either a clockwise or counter clockwise manner pursuant to threads 108. Upper portion 112 of second portion 105 is typically a head that may be used for turning second portion 105 in or out of first portion 103 and also includes index mark 124 for use in the precision system of the present invention which will be described in more detail hereinafter.

Finally, third segment or rod 102 includes external threads 110 for being threadably inserted into the inside of second portion 105. Third portion 102 is screwed into second portion 105 and extends concentrically and coaxially into bore 130. The longitudinal, or axial, position of rod 102 into bore 130 may be selectively adjusted to multiple positions by screwing the rod up or down in a clockwise or counterclockwise direction. A jam or locking nut 106 is screwed onto rod 102 and when the rod is in a selected position the lock nut 106 is screwed tightly against head 112 of second portion 105 to lock rod 102 into position. The lower end of rod 102 has a decapping pin 104 for use in the overall reloading process.

In accordance with the present invention, a precise measuring system is provided so as to precisely adjust the position of bore 130 relative to its axial location within first portion 103, which is securely set in a reloading press. The precise measuring system of the present invention includes threads 108 that have a predetermined number of threads per inch in order to achieve an advance of a predetermined longitudinal distance for each 360 degree revolution of head 112 into first portion 103. For example, external threads 108 may have a pitch of 20 threads per inch such that for each 360 degree rotation of head 112, bore 130 (which moves with the movement of second portion 105) moves a corresponding longitudinal distance of 1/20 inch within first portion 103. Further, it is understood that the movement of second portion 105 within first portion 103 effectively re-positions die 100 within a reloading press because the position of bore 130 is being adjusted. Additionally, because first portion 103 remains fixed relative to its position in a holding press, lock nut 116 does not require readjustment to adjust the position of bore 130. Further, the present invention includes index marks 122 on head 118 and index mark 124 on head 112. Accordingly, by placing a predetermined number of index marks 122 equally spaced around the circumference of head 118, very small longitudinal adjustments of bore 130 may be made in a substantially precise manner. For example, assuming that there are 50 index marks equally positioned around head 120 and assuming that threads 108 have a pitch of 20 threads per inch, then for each rotational adjustment of head 112 with respect to any two index marks 122, bore 130 would be adjusted by one thousandths of an inch (0.001 inches) within first portion 103. Therefore, after a first cartridge case was resized and it was determined that the headspace distance of the cartridge was four thousandths of an inch too long, for example, then the precise measuring system of the present invention may be utilized to quickly and efficiently adjust the position of bore 130 by simply rotating head 112 four index marks with respect to index marks 122 thereby repositioning bore 130 by four thousandths of an inch within first portion 103. Once this was performed, lock screw 120 may be used to secure and lock second portion 105 onto first portion 103 and the next cartridge case that is resized will be of the accurate and precise headspace distance.

Figure 3:
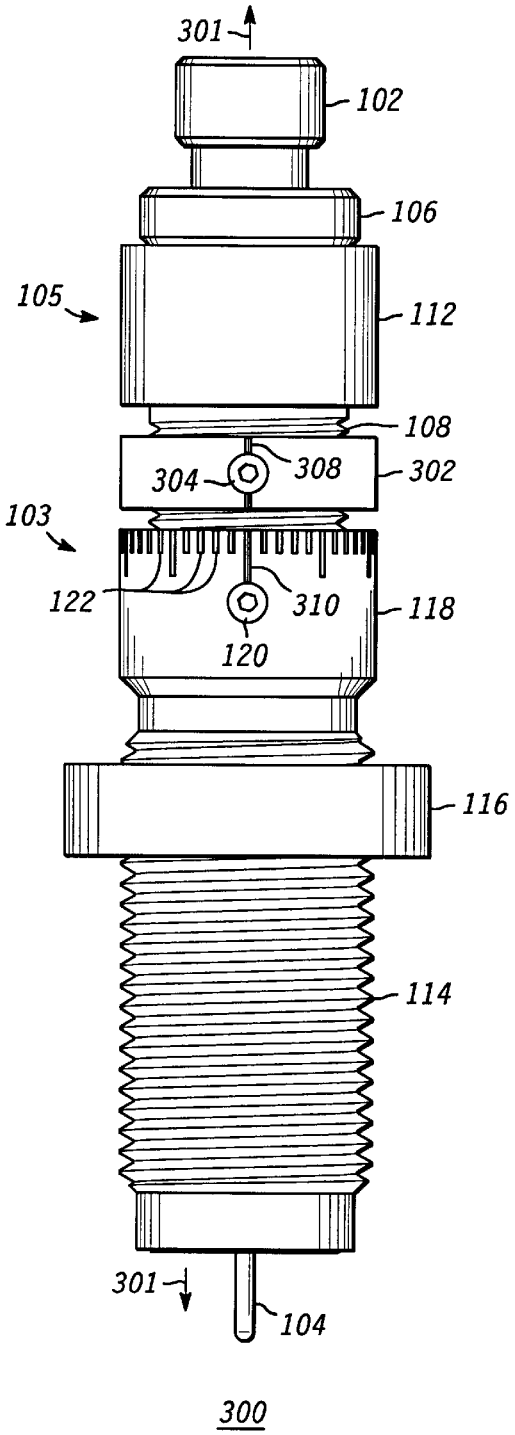
FIG. 3 is a pictorial diagram of an alternate embodiment of the present invention.
Figure 4:
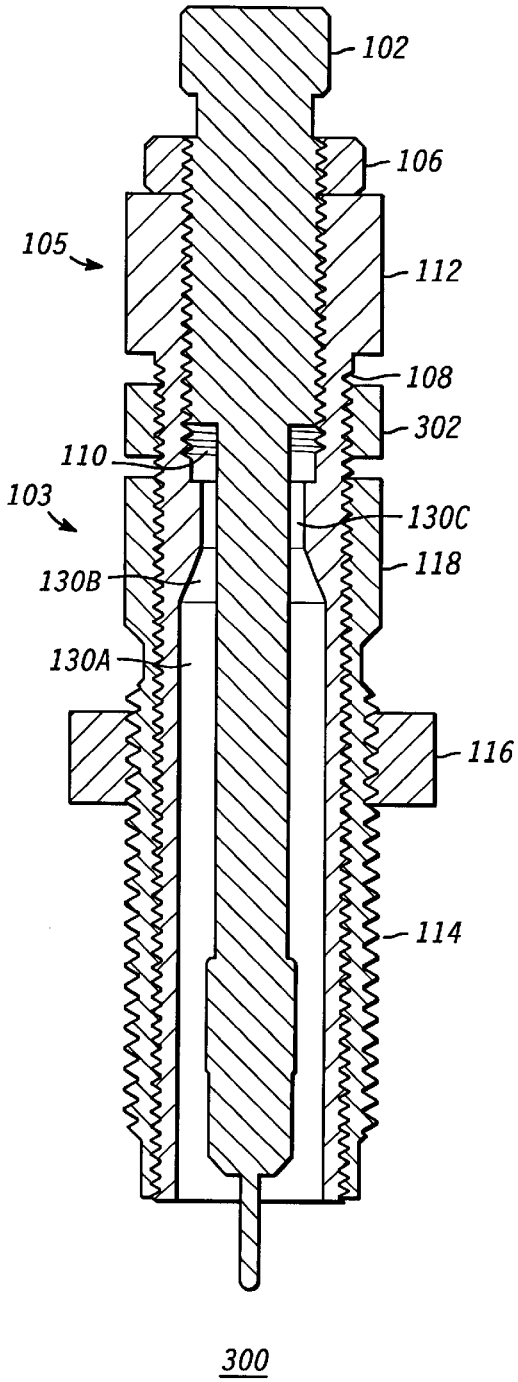
FIG. 4 is a cross-sectional view of the resizing die taken along lines 301—301 of FIG. 3.

Referring now to FIGS. 3 and 4, a second embodiment of the present invention is shown. FIG. 3 is a pictorial diagram illustrating resizing die 300 while FIG. 4 is a cross sectional view of die 300 taken along lines 301—301 of FIG. 3. It is understood that components shown in FIGS. 3 and 4 that are identical to components shown in FIGS. 1 and 2, respectively, are identified by like reference numbers. Resizing die 300 includes a modified precise measuring; system having a zero calibration mechanism. In particular, die 300 includes nut 302 for threadably attaching to second portion 105 via threads 108. Nut 302 also includes lock screw 304 and index mark 308 that are similar to lock screw 120 and index mark 124, respectively, of FIG. 1.

In operation and referring to the above example, after a first cartridge case was resized and it was determined that the headspace distance of the cartridge was four thousandths of an inch too long, for example, then the precise measuring system of FIGS. 3 and 4 may be utilized to quickly and efficiently adjust the position of bore 130 by simply rotating head 112 four index marks with respect to the alignment of index marks 122 and 306 thereby repositioning bore 130 by four thousandths of an inch within first portion 103. As head 112 is turned, center index mark 308 of nut 302 will no longer be aligned with center index mark 310 of head 118. However, assuming lock screw 304 is loose and allows nut 302 to freely rotate around threads 108 without causing a corresponding rotation of second portion 105, then nut 302 may be readjusted or calibrated so that marks 308 and 310 are re-aligned. Once this was performed, lock screw 304 may be used to secure nut 302 onto second portion 105. Accordingly, this alternate embodiment provides a precise measuring system that includes a zero calibration system such that when bore 130 is adjusted within first portion 103, nut 302 may be repositioned so that index marks 304 and 310 again line up with each other. This allows the user of the die 300 to always start from a common reference point.

Figure 5:
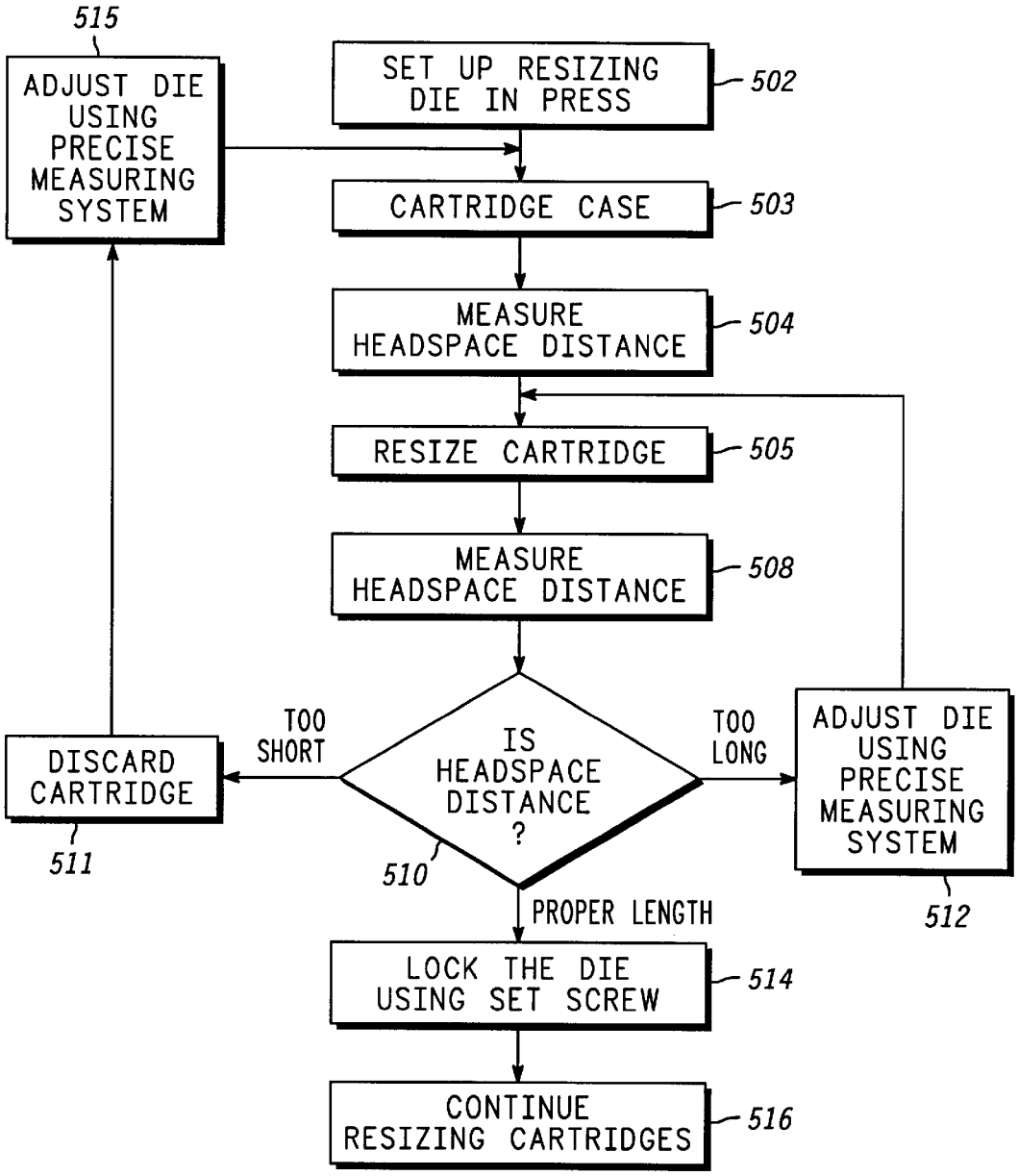
FIG. 5 is a detailed flow chart illustrating the process steps for efficiently and quickly adjusting a cartridge case resizing die within a reloading press.

Referring to FIG. 5, a flow chart describing the die resizing process in accordance with the present invention is shown.. First, the resizing die 100 is set up in a press such as press 10 of the '806 patent (step 502). A cartridge case is selected (step 503) and its headspace is measured (step 504), using a micrometer device such as the one described in U.S. Pat. No. 4,918,825, to obtain a first reference measurement. The selected cartridge case is then placed in the holder of press 10 and is resized in accordance with the '806 patent (step 505). Next, the headspace distance of the resized cartridge case is measured again (step 508).

If the cartridge case is too long, the precision measuring system of the present invention is adjusted, as described above, by the distance that the cartridge case was too long (Step 512). The process then reverts back to step 505 where the cartridge is again resized and the headspace distance is again measured whereby it should now be very precise after just one resizing operation. If, however, the cartridge case was too short, then the cartridge case is discarded (step 511), and the precision measuring system of the present invention is adjusted, as described above, by the distance that the cartridge case was too short (Step 515). The process then reverts back to step 503 where another cartridge case is selected whereby the position of the resizing die within a holding press should now be very precise after just one resizing operation. Once the proper headspace distance is achieved, the precise measuring system of the present invention is locked into place (step 514) and the resizing of additional cartridge cases may be continued (step 516).

By now it should be apparent that a novel resizing die for a cartridge case has been provided for efficiently and quickly resizing a cartridge case during a reloading operation. The novel die includes a precise measuring system for being able to accurately and precisely adjust the position of the resizing die when already threaded into an internal bore of a reloading press so that after a first resizing process is performed, the resizing die of the present invention may be precisely adjusted by the length that the cartridge's headspace distance is too long or too short so that the next resizing process will yield a cartridge headspace distance that is in substantial accordance with a predetermined length.

While the invention has been described in conjunction with a specific embodiments thereof, many alternatives, modifications and variations will be apparent to those of ordinary skill in the art in light of the foregoing description. Accordingly, the invention is intended to embrace all such alternatives, modifications and variations as fall within the broad scope of the appended claims.

What is claimed is:

1. A die for resizing a cartridge case, comprising:

a first portion having external threads for being threadably inserted into a bore of a holding press, said first portion including a head whereby said first portion may be adjustably positioned in an axial manner within said bore of said holding press by rotating said head of said first portion;

a second portion having external threads for being threadably inserted into an inside of said first portion, said external threads of said second portion having a predetermined number of threads per inch, said second portion having a bore that substantially conforms to an external configuration of a cartridge case to be resized, said second portion also including a head whereby said second portion may be adjustably positioned in an axial manner within said first portion by rotating said head of said second portion, wherein said external threads of said second portion are threadably connected to said inside of said first portion for substantially the entire length of said first portion;

a third portion having external threads for being threadably inserted into said bore of said second portion, said third portion having a decapping pin at a first end; and a measuring system including:

a predetermined number of index marks on said head of said first portion that are equally positioned around said head of said first portion;

at least one index mark on said head of said second portion; and wherein a rotational movement of said head of said second portion of a distance substantially equal to a distance between any two of said predetermined number of index marks corresponds to a substantially precise movement of said bore of said second portion within said first portion.

2. The die of claim 1 wherein said substantially precise adjustment is a function of said predetermined number of threads per inch and said predetermined number of index marks.

3. The die of claim 1 wherein said head of said first portion includes a lock screw for securing said second portion within said first portion.

4. The die of claim 1 wherein said external threads of said second portion have a pitch of twenty threads per inch.

5. The die of claim 1 wherein said predetermined number of index marks on said head of said first portion is 50.

6. A die for resizing a cartridge case, comprising:

a first portion having external threads for being threadably inserted into a bore of a holding press, said first portion including a head whereby said first portion may be adjustably positioned in an axial manner within said bore of said holding press by rotating said head of said first portion;

a second portion having external threads for being threadably inserted into an inside of said first portion, said external threads of said second portion having a predetermined number of threads per inch, said second portion having a bore that substantially conforms to an external configuration of a cartridge case to be resized, said second portion also including a head whereby said second portion may be adjustably positioned in an axial manner within said first portion by rotating said head of said second portion, wherein said external threads of said second portion are threadably connected to said inside of said first portion for substantially the entire length of said first portion;

a third portion having external threads for being threadably inserted into said bore of said second portion, said third portion having a decapping pin at a first end; and a measuring system including:

a first predetermined number of index marks on said head of said first portion that are equally positioned around said head of said first portion;

a nut having internal threads for being threadably adjustable on said external threads of said second portion, said nut having a second predetermined number of index marks thereon that are equally positioned around said nut; and wherein a rotational movement of said head of said second portion of a distance substantially equal to a distance between any two of said first predetermined number of index marks with respect any one of said second predetermined number of index marks on said nut corresponds to a substantially precise movement of said bore of said second portion within said first portion.

7. The die of claim 6 wherein said head of said first portion includes a lock screw for securing said second portion within said first portion.

8. The die of claim 6 wherein said nut includes a lock screw for securing said nut on said external threads of said second portion.

9. The die of claim 6 wherein said nut may be adjustably rotated on said external threads of said second portion such that a first one of said second predetermined number of index marks aligns with a first one of said first predetermined number of index marks.

10. A method for resizing a cartridge case using a resizing die, the method comprising the steps of:

inserting said resizing die in a holding press;

performing a resizing operation of a cartridge case;

measuring a headspace distance of said cartridge case; and rotationally adjusting a first portion of said resizing die corresponding to a measurement that said headspace distance of said cartridge was too long or too short, wherein such rotational adjustment of said portion of said resizing die corresponds to a substantially precise adjustment of a position of a bore of said resizing die relative to its position in a holding press, wherein said resizing die includes said first portion and a second portion and wherein said first portion remains in a fixed position relative to its position in said holding press when said second portion is adjusted and wherein said external threads of said second portion are threadably connected to said inside of said first portion for substantially the entire length of said first portion.

11. The method of claim 10 wherein said resizing die includes said first portion and a second portion and wherein said first portion remains in a fixed position relative to its position in said holding press when said second portion is adjusted.

* * * * *